United States Patent [19]

Suwannukul

[11] Patent Number: 4,937,565

[45] Date of Patent: Jun. 26, 1990

[54] CHARACTER GENERATOR-BASED GRAPHICS APPARATUS

[75] Inventor: Sakarin Suwannukul, Oakland, Calif.

[73] Assignee: Hercules Computer Technology, Berkeley, Calif.

[21] Appl. No.: 878,017

[22] Filed: Jun. 24, 1986

[51] Int. Cl.[5] ..... G09G 1/16

[52] U.S. Cl. ..... 340/735; 340/723; 340/747; 340/748; 340/750

[58] Field of Search ..... 340/748, 735, 747, 723, 340/790, 750, 798, 799, 789, 723, 729

[56] References Cited

U.S. PATENT DOCUMENTS

| | | | |
|---|---|---|---|
| 4,316,188 | 2/1982 | Cancasci, Jr. | 340/735 |
| 4,392,130 | 7/1983 | Lundstrom et al. | 340/747 |
| 4,398,190 | 8/1983 | Long et al. | 340/747 |
| 4,439,761 | 3/1984 | Fleming et al. | 340/735 |
| 4,451,825 | 5/1984 | Hall et al. | 340/735 |
| 4,517,560 | 5/1985 | Murayama et al. | 340/735 |
| 4,556,878 | 12/1985 | Dwirz et al. | 340/747 |
| 4,563,677 | 1/1986 | Seiler | 340/750 |
| 4,613,856 | 9/1986 | Olin et al. | 340/723 |
| 4,672,371 | 6/1987 | Bugg | 340/735 |
| 4,679,027 | 7/1982 | Higuchi | 340/735 |

*Primary Examiner*—Gerald L. Brigance

*Attorney, Agent, or Firm*—Limbach, Limbach & Sutton

[57] ABSTRACT

A graphics display apparatus using a character generation architecture is disclosed. A font memory is disclosed which can be addressed to provide a different character for each character position on a display screen. In this manner graphics images can be manipulated at character generation speeds. Further, memory can be more efficiently used and font registers and additional pages of memory are not required to accommodate an expanded font list. In accordance with the present invention, attributes are generated in hardware so that the base text can remain unchanged even though the attributes of the text are changed. A unique echo circuit is provided to generate a bold faced attribute, including an anti-smear function. In the preferred embodiment of the present invention, a single memory is used to store textual and font information, thus reducing the size and costs of the character generation architecture. In the preferred embodiment of the present invention, a dynamic memory is used and a refreshing scheme is provided for refreshing selected portions of the memory during the active video portions of the device operation.

4 Claims, 7 Drawing Sheets

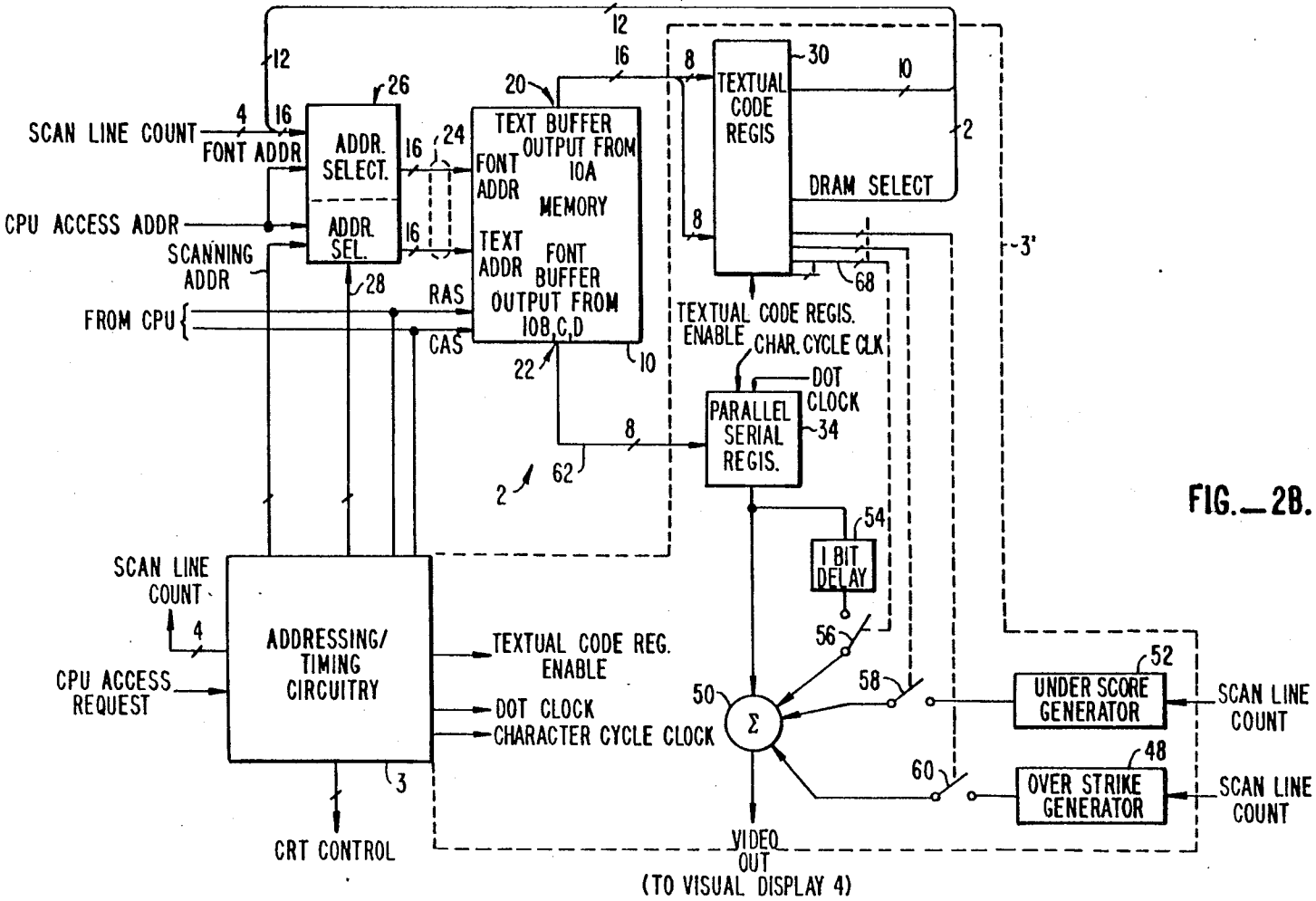
FIG.—2B.
SCAN LINE COUNT
SCAN LINE COUNT
UNDER SCORE GENERATOR
OVER STRIKE GENERATOR
52
48
3'
2
10
DRAM SELECT
30
TEXTUAL CODE REGIS
68
TEXTUAL CODE REGIS.
ENABLE
CHAR. CYCLE CLK
DOT CLOCK
34
PARALLEL SERIAL REGIS.
54
1 BIT DELAY
56
58
60
50
VIDEO OUT
(TO VISUAL DISPLAY 4)
8
8
12
16
10
TEXT BUFFER OUTPUT FROM IOA
MEMORY
FONT BUFFER OUTPUT FROM IOB,C,D
20
FONT ADDR
TEXT ADDR
22
62
2
24
16
16
RAS
CAS
26
ADDR. SELECT.
ADDR SEL.
28
12
16
4
FONT ADDR
SCAN LINE COUNT
CPU ACCESS ADDR
SCANNING ADDR
FROM CPU
TEXTUAL CODE REG. ENABLE
DOT CLOCK
CHARACTER CYCLE CLOCK
ADDRESSING/ TIMING CIRCUITRY
3
CRT CONTROL
SCAN LINE COUNT
4
CPU ACCESS REQUEST

CHARACTER GENERATOR-BASED GRAPHICS APPARATUS

TECHNICAL FIELD

The present invention is directed to character generation apparatus, and more specifically to an apparatus for generating video signals corresponding to visual graphics image using a character generator type architecture.

BACKGROUND ART

Currently, character generation architectures assume an 8 bit standard. That is, characters are designated by an 8 bit "ASCII" code. This inherently limits the number of different characters and fonts which can be designated to display textual information, or cells to display graphics information, on a visual display screen. Current solutions include the use of a static screen font register and multiple pages of memory, each page of memory storing a different font or group of characters. The contents of the font register determine which page of font memory is to provide the data corresponding to the character codes being supplied in common thereto. While such an architecture provides additional or different fonts, the requirement of a font register and additional memory add complexity and cost to the design and places significant restriction on the manner in which the fonts are used. This renders such architecture a satisfactory solution in only some of the possible applications of character generation schemes.

Examples of current character generation schemes based on an 8 bit character code are U.S. Pat. Nos. 3,911,420, 4,203,102, 4,283,724, 4,330,834, 4,384,285, 4,415,890, 4,437,167, 4,446,457, and 4,520,356.

As a matter of background, textual character generation architectures typically are used to display 256 characters and symbols that are pre-defined in a ROM chip called the character generator. These 256 characters consist, for example, of the standard 128 ASCII characters, plus another 128 graphics symbols and foreign language characters.

Each character can be displayed, for example, with the following attributes: underline, reverse video, blank, blink, and high intensity.

A visual display screen is divided into 2000 cells (80 columns by 25 rows). Each cell can contain one of the 256 characters, which is specified by an 8-bit character code and an 8-bit attribute code stored in a text buffer.

Textual character generation has historically been the most popular mode for processing text because of its speed and simplicity. However, there has been a recent trend toward bit-map graphics techniques for processing text, for greater flexibility in defining character fonts, despite the penalty of complexity and slowness.

In bit-map graphics mode, software can manipulate each individual pixel. This capability is both a blessing and a curse. On the one hand, it permits virtually any graphics image—from an electronic schematic to a Cessna 182 instrument panel—to be displayed on the screen.

But on the other hand this versatility has its price in that the graphics programmer must draw each dot, unaided by a character generator. Because of this added complexity, text processing in graphics mode is generally much slower than in text mode.

Consider, for example, how the letter "T" is generated under both modes. In text character generation architectures, it requires, for example, only that 0054H (the ASCII code for "T" and the attribute code for "normal") be stored in the video, or text, buffer. With this code, a capital "T" is drawn on a 9×14 matrix of pixels, for example, in the appropriate cell location.

In bit-map graphics mode, each pixel of a 9×14 matrix must be individually specified: to display a "T," 126 bits of information are needed, versus the number of bits required to address the character in text character generation mode. The advantage of bit-map graphics mode is that it is not confined to a single text font style, but can display virtually any graphics image.

Programmers working in the graphics mode must also typically initialize a CRT controller, which is addressed through an index and a data register. These parameters govern such factors as the total number of characters per row, the number of visible rows, and how the screen is scanned.

SUMMARY OF THE INVENTION

The foregoing problems and disadvantages of prior character generation architectures are overcome by the present invention of a character generation system including a font buffer which stores at least as many different characters as there are character positions on a visual display. The present invention provides a character generation system in which an image is displayed on a screen having a display area defined by a designated number of character positions, wherein the image is comprised of characters and the characters are each defined by a corresponding cell of font data, each cell of font data being designated by a corresponding textual or character code. The system includes a text buffer for storing the textual or character codes corresponding to the characters which form the image, and a font buffer which is addressable by the textual or character codes for storing a plurality of different cells of font data, wherein the number of different cells of font data stored in the font buffer is at least as great as the designated number of character positions of the screen display area.

In the preferred embodiment of the present invention over three thousand different characters are stored in the font memory, and the textual data stored in memory is 2 bytes wide, 12 bits of which are used to address a font memory and 4 bits of which are used to directly control the character attribute.

The present invention permits "cells" of data to be addressed as if they were characters and to be used to assemble graphics and pictorial images of such resolution which is comparable to bit-map graphics systems. In turn, this creates a new dimension in graphic and image generation and manipulation.

In a preferred embodiment of the present invention, both textual as well as font data are stored in a common memory. Retrieved textual data is used to address the memory to retrieve font data. Preferably, the amount of font memory available for storage of fonts or cells is chosen so that, for a given range of font or cell dimensions, a different font or cell can be addressed for display on the visual display for each of the character positions of the visual display. Thus, for a given image the preferred embodiment of the present invention will permit the image to be formed of all different cells.

In accordance with the present invention, a bit-map graphics type image can be obtained and can be manipulated with a substantial increase in speed, but all with character generation type architecture.

Further enhancing the flexibility provided by the present invention in the generation of text and images is a character-code-designated hardware-generated bold face attribute which has the effect of doubling the number of available fonts. In the preferred embodiment of the present invention, bold facing of a character is requested by including a bold face bit in the attribute portion of the character code. Hardware which is responsive to the attribute data responds to the bold face bit and causes the font data emerging from the font buffer to be "bolded". In other words, the bold face attribute of the present invention operates on existing font data.

In accordance with the present invention the double width or boldface character attribute is provided by way of an echo path which supplements the video signal path. An anti-smear circuit is included to maintain a distinct separation between characters.

Circuitry is provided to supply control and addressing to the memory so that textual codes and font data can be retrieved from the memory during one part of a character cycle and refreshing of the memory can be performed in another part of a character cycle.

Further in accordance with the present invention the attribute information contained in the character code directly controls the generation of the character attributes, and such attributes are summed with the video signal being supplied to the visual display. For example, underscore and overstrike generators are provided, in addition to the bold face function, each of which is responsive to the scan line count. The output of the underscore generator and overstrike generator are coupled, via gates which are controlled by the attribute data, to be summed with the video output signal. Thus, when the character code contains an attribute bit which calls for an underscore attribute, the switch connecting the underscore generator to the summing circuit is closed. In the absence of such a bit, the switch is open. The same holds true for the overstrike attribute. This real time, hardware generation of character attributes permits various attributes to be provided for the same character without modifying the base character code defining the character.

Another feature of the invention is the use of a dynamic random access memory as the textual and font storage means. While a static RAM can be used with satisfactory results, use of a dynamic RAM results in a lower cost and requires less space. Refreshing means are provided to refresh the font storage area of the memory during otherwise idle periods of the memory. As such, a less expensive, smaller sized, character generation system with fast bit-map graphics characteristics can be achieved. Further, the fonts or cells themselves can be changed without affecting the "textual" storage area, so that the character of the display image can be changed.

It is therefore an object of the present invention to provide character generation apparatus which provides a greatly expanded number of available fonts by way of a font addressing scheme which uses addresses greater than 8 bits wide.

It is an object of the present invention to provide bit-map graphics type images using character generation architecture.

It is another object of the present invention to provide a character generation architecture in which attributes are generated in hardware and in real time so that the base text can remain constant.

It is a further object of the present invention to provide a character generation architecture in which a bold face attribute is provided by way of a supplemental echo signal path in the video signal path.

It is still another object of the present invention to provide a character generation architecture which employs a dynamic random access memory for storing both textual as well as font data.

It is another object of the present invention to provide a character generation architecture which employs a dynamic random access memory for storing font and textual data and which provides refresh means for refreshing the font storage area of the dynamic random access memory during a character cycle.

These and other objectives, features and advantages of the present invention will be more readily understood upon considering the following detailed description and accompanying drawings.

BRIEF DESCRIPTION OF THE DRAWINGS

FIG. 2B is a simplified block diagram of the character generation architecture of the present invention.

DETAILED DESCRIPTION OF THE PRESENT INVENTION

Figure 1:
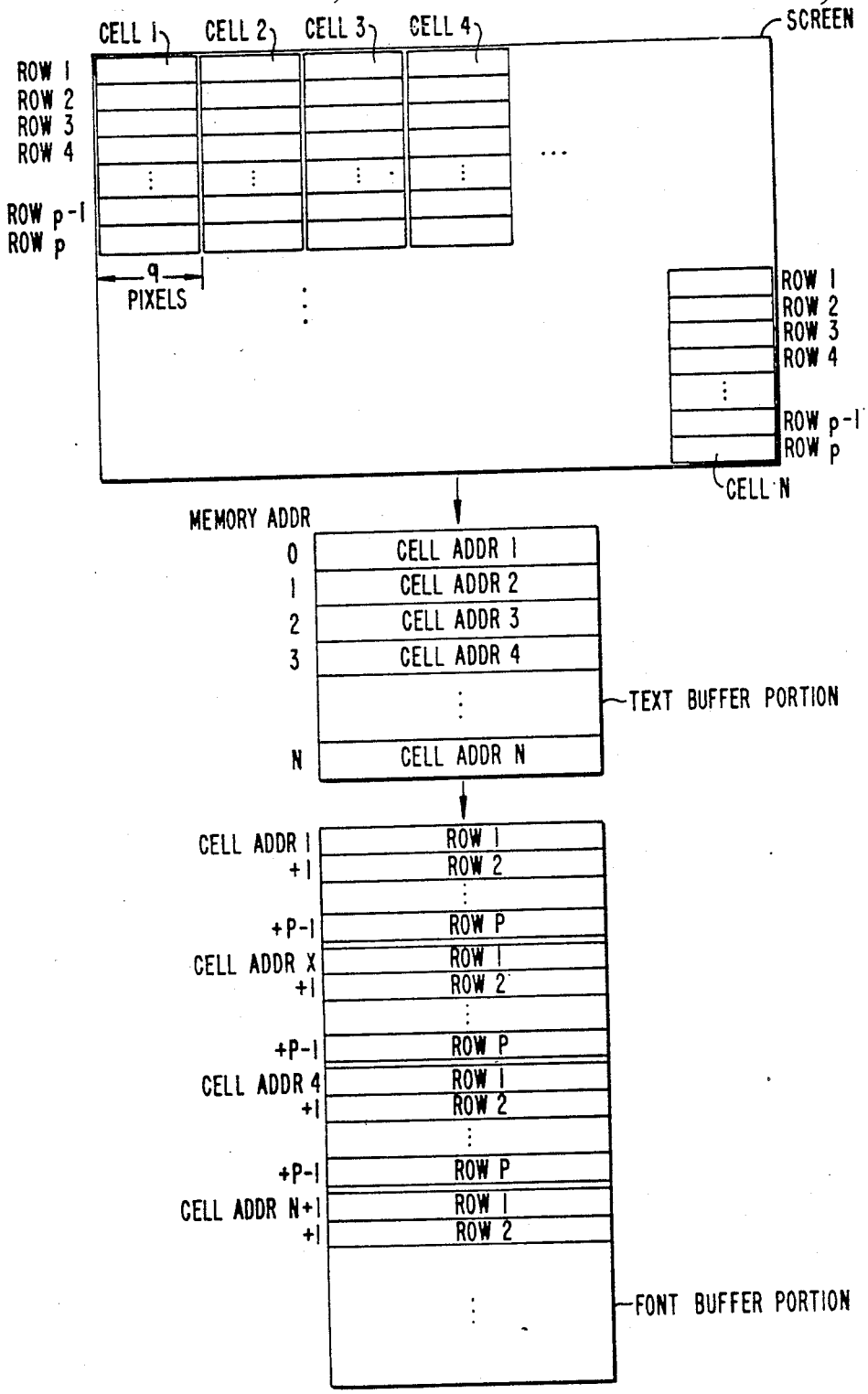
FIG. 1 is an illustration of the relationship between character cells on the visual display, the text buffer, and the font buffer.

A significant advantage of the architecture of the present invention is that it permits what has heretofore been considered architecture for generating textual materials, or, at best, crude graphics images, to be transformed into a system which can provide high quality, highly flexible graphics and pictorial image generation and manipulation. What has heretofore been considered a font memory, now has the expanded capacity to be a graphics cell memory or graphics cell library which can provide a different character for each and every character position on the display screen. In turn, this permits highly complex images to be manipulated at speeds greater than that available from normal bit-mapped graphics systems. Thus, unlike present graphic systems which utilize a refresh buffer that is manipulated pixel by pixel to provide a one-for-one storage of pixel data to be displayed on the screen, the present invention utilizes a textual buffer and a cell library to provide many of the same capabilities that present graphic systems provide. For example, because the cell library is stored in a random access memory, individual cells can be easily modified without changing the content of the text buffer or the rest of the cell library. Thus if certain cells are associated with certain portions of the visual image to be displayed, those cells can be addressed directly and modified during a nonvideo portion of the visual display cycle. Where the entire image is made up of different cells the font buffer will be able to supply all required cells. Operations such as panning the image can be achieved by appropriate addressing of the textual memory. Scrolling of the image is achieved by simply scrolling the text buffer as one would do so if textual information was stored in the buffer.

The preferred embodiment of the present invention combines the speed and ease-of-use of text mode with much of the versatility of graphics mode. It does this by allowing the user to define up to 3072 characters, and display them as easily as if they were being produced by a character generator.

In effect, the present invention provides a bit map for creating images; but instead of forcing the software to address each pixel individually, as is done in bit map graphics, the bit map is divided into cells of, for example, 16 bytes, each of which is accessible with a 12-bit character code and a four bit attribute code.

A 12-bit character code allows the addressing of 3K characters, rather than the 256 characters addressable with prior text generation architecture 8-bit character codes. Three thousand seventy two characters is the equivalent of twelve full 256 character fonts, allowing for several fonts to be displayed at once.

The number of characters displayable at one time can vary with the size of the character matrix. A 9×16 matrix, will display 8×2 characters. An 8×8 matrix will display 90×43 characters on the screen. Characters can be strung together to create large ones; for example, two 8×16 cells will create 16×16 cells, four 8×12 cells will create 16×24 cells.

Thus, in accordance with the present invention, by providing a cell library which can store in continuous address space at least a different character for each character position display on the visual display, one can greatly expand the usefulness of text generation based of video display terminals.

As a matter of background, textual information is typically displayed on a cathode ray tube in a format of 24 rows, each having 80 characters. Each character row is formed of a number of parallel scan lines, for example 16 scan lines, and each scan line is formed of a plurality of pixels. Characters are displayed on the cathode ray tube in predefined regions, for example regions 8 pixels wide and 16 scan lines high. In the formation of a row of characters, the pixels forming the first scan line of each of the characters in the row to be displayed is provided consecutively to the CRT. Next, the 8 pixels forming the second scan line of each of the characters in the row are provided sequentially to the CRT, and so on, for each of the 8 pixels in each of the scan lines for the characters in the row until all 16 scan lines have been provided to the CRT. This is explained in greater detail in U.S. Pat. No. 4,330,834, referred to above and incorporated to that extent herein by reference. Thus, in the display of a row of textual information, the character code for each of the characters in the row is read out of the textual portion of memory and applied seriatim to address the font portion of memory. The reading out of the character codes for the row is repeated for a period corresponding to 16 consecutive scan lines. The portion of each character code which is used to address the font portion of memory is supplemented with the scan line count to indicate which scan line of the character font is currently being addressed.

Referring to FIG. 1, the relationship is illustrated between character cells displayed on the visual display screen, the cell addresses stored in the text portion of the memory, and the cell data stored in the font portion of the memory. It can be seen that, for a cell dimension of p rows and q pixels, N cells will be required to fill the visual display screen. For purposes of simplicity, the first four and the Nth cells which make up the visual image are shown. From FIG. 1 it can be seen that the addresses for each of the cells which make up the visual display are stored in sequence in the text buffer portion of the memory. Thus the text buffer portion can be scanned by a periodic sequential addressing scheme to read out all of the addresses of the cells to be displayed on the screen.

From FIG. 1, however, it can also be seen that the cells need not be stored in the font buffer portion of memory in any particular order. Thus, so long as the address of the desired cell is known, it can be retrieved from the font buffer portion. It is to be noted that each row of a cell is stored in sequence in the font buffer portion. This also means that modification to the text buffer can be made independently of the font buffer and vice versa. From a practical sense font changes can easily be made for whatever applications program is being executed by the user. The retrieval of any character from the font buffer is thus the same as that for the conventional character generation scheme.

When the present invention is employed to provide graphics images, it can be seen that the image can be modified at significantly higher speeds than conventional graphics systems. Where a cell is 8 pixels wide and 16 rows high this means that by changing a single address in the text buffer 8×16 pixels are automatically defined by the font buffer. In contrast, in conventional bit-map graphics systems each pixel is defined on a pixel-by-pixel basis. Thus, in the example above, a sixteen fold increase in speed can be achieved.

Figure 2A:
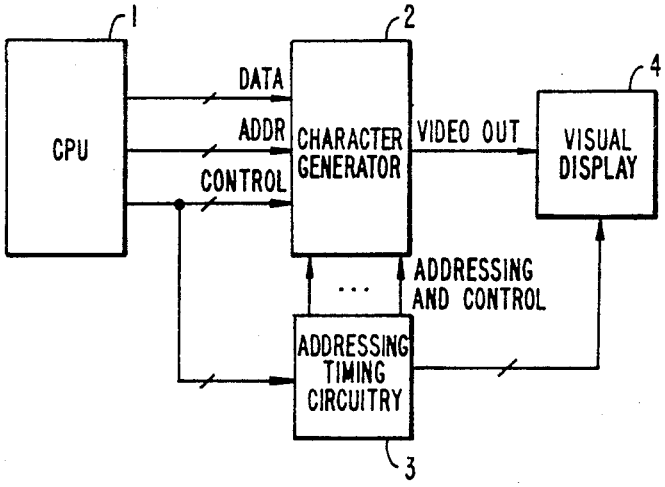
FIG. 2A is a simplified block diagram illustrating the position of the character generation architecture of the present invention with respect to the visual display and a central processing unit.

Referring to FIG. 2A, a central processing unit 1 provides textual data, addresses and control information to the character generator 2 of the present invention. In turn, the character generator 2 supplies video output signals, representative of the textual information, to visual display 4 for display. Addressing/timing circuitry 3 provides horizontal and vertical synchronizing signals to visual display 4, as well as provides addressing and control signals to character generator 2.

Referring to FIG. 2B, the present invention employs a memory 10, preferably a dynamic memory, which stores both textual codes and font data. It is to be understood that the terms "font data" and "textual codes", as used herein are not intended to be limited to their literal meaning, and that the term "font data" can also refer to cells of image data, and that the term "textual codes" can also refer to a code, address, or designation of a cell of image data. Memory 10 is accessed during one part of a character cycle to provide the textual code for that part of the textual data to be displayed in the next character cycle, and, at the same time, is addressed by the textual code retrieved during the previous character cycle to provide font data. The font data provides pixel information for driving a cathode ray tube ("CRT") or the like.

Figure 4:
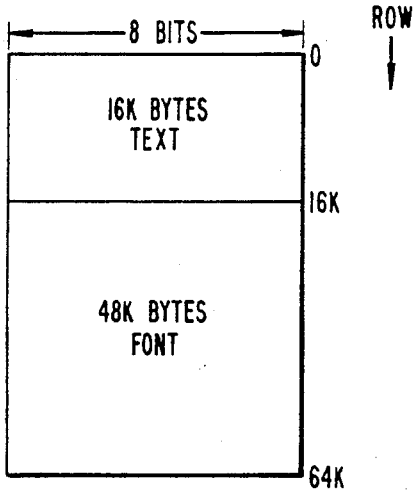
FIG. 4 is a memory map of the dynamic memory of the present invention.
Figure 3:
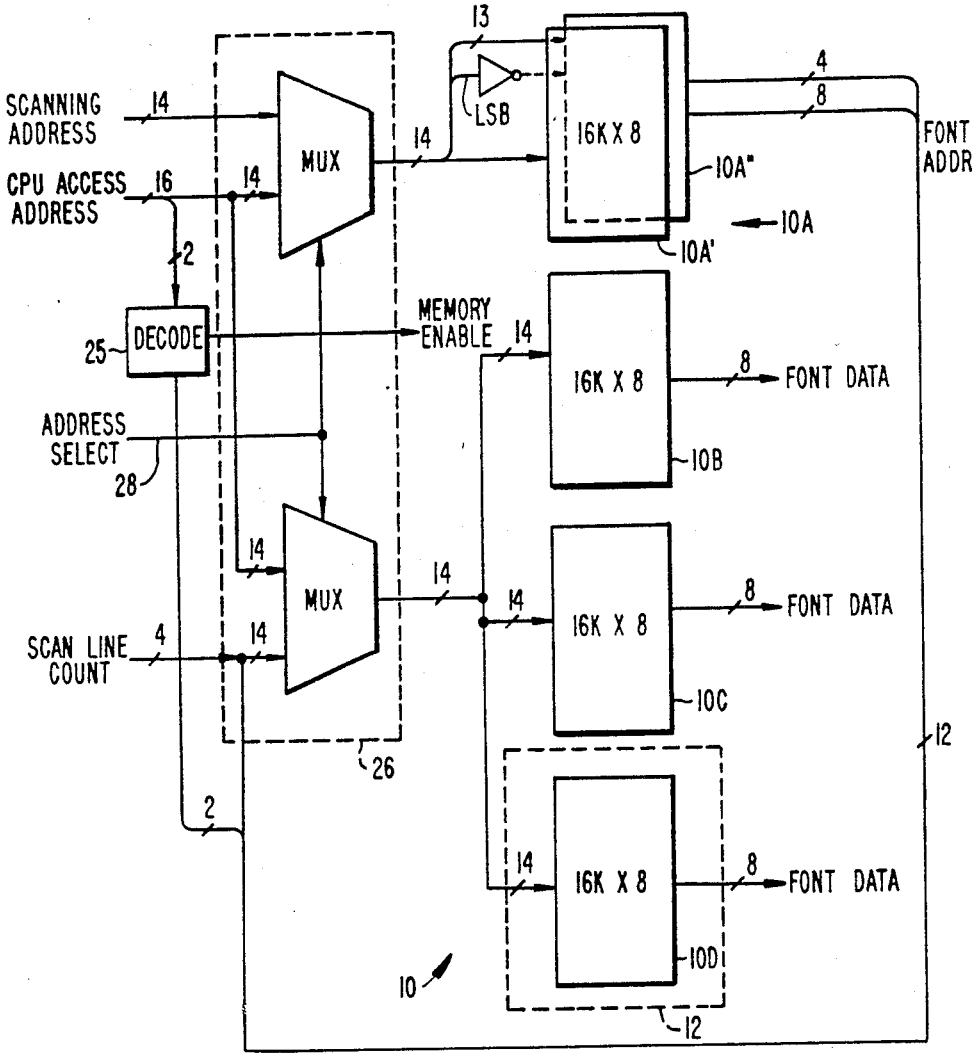
FIG. 3 is a simplified functional block diagram of the dynamic memory employed in the present invention.

Referring to FIGS. 3 and 4, the arrangement of the memory and the allocation of the memory addressing are illustrated. In the preferred embodiment of the present invention four 16K×8 bit dynamic random access memory devices ("RAMs") are employed. These can be device number MB81416, available from Fujitsu of America, of Santa Clara, Calif. FIG. 3 illustrates general architecture by which these devices are arranged.

In the preferred embodiment of the present invention, textual codes are 2 bytes wide, font data is addressed by way of a 12 bit wide word, which is a part of each textual code, and the font data provided for each character is 8 pixels wide and 16 scan lines high. One of the four 16K×8 bit dynamic random access memories ("DRAMs") is enclosed in dotted lines 12 of FIG. 3.

For access by the CPU, each of these 16K×8 bit devices is addressed in parallel with the others with a sixteen bit address, and provides an eight bit output or receives eight bits of data for storage. Two of the sixteen bits are decoded by decode circuit 25 to enable one of the four 16K×8 DRAMs to be written or read by the CPU.

When the DRAMs are accessed by the address/timing circuitry 3 to generate the video signal for display, DRAM 10A (the text buffer) receives the scanning address and, in turn, addresses DRAMs 10B, C and D, the font buffer.

In a further embodiment of the present invention, text buffer 10A is actually two identical 16K×8 bit DRAMs 10A' and 10A", each storing the same data at the same addresses. When text buffer 10A is addressed by the address/timing circuitry 3, DRAM 10A' is supplied with the actual address and DRAM 10A" is supplied with an address which is the actual address with its least significant bit complimented. In this manner, a 16 bit word can be read out of the text buffer 10A at one time.

From FIG. 4 it can be seen that, in the preferred embodiment of the present invention, storage for 16K bytes of text is provided. The remainder of the memory provides 48K bytes of font or cell storage.

As discussed above, in the preferred embodiment of the present invention the font storage portion of memory 10 is accessed randomly.

Returning to FIG. 2B, the addressing of memory 10 will now be described in greater detail. The addresses to memory 10, provided on address bus 24, take a number of forms: (1) font addresses, which are the combination of the scan line count and a portion of the character codes stored in the textual portion of memory; (2) scanning addresses for scanning the textual storage area of memory 10; and (3) CPU access addresses. Address selector 26 selects from among these different addresses under control of an address selection signal on line 28 and provides the selected addresses to the font address port and the text address port of memory 10.

In the preferred embodiment of the present invention, the reading out of a textual code from the textual portion of memory and the addressing of the font portion of memory with a portion of a previously read-out textual code is accomplished in a character cycle. Twelve bits from character code register 30 are combined with the 4 bit scan line count to provide a 16 bit font address. Two of the 12 bits from the character code register 30 are supplied to decoder 25 to enable one of DRAMs 10B, C or D. The scan line count and the other 10 bits from character code register 30 are applied to address selector 26 to provide a 14 bit font address. During a given character cycle a scanning address is supplied by address selector 26 on the address bus 24 to the text address port of memory 10 and a font address, part of which was read out of the textual portion of memory in the previous character cycle, is supplied by address selector 26 on the address bus 24 to the font address port of memory 10. This also causes the font data corresponding to the current font address to be made available at the font buffer output port 22 for storage in parallel to serial register 34. On the rising edge of the next character cycle, the character code and the font data are loaded into registers 30 and 34 respectively. The 8 bit word in register 34 provides 8 pixels for the particular portion of the scan line being then scanned on the CRT in that character cycle, but correspond to the font which was addressed in the previous character cycle.

With respect to the 12 bits stored in character code register 34, these bits are obtained from the 2 bytes retrieved from the text buffer in response to the scanning address. One of these bytes can be viewed as a character code and the other can be viewed as an attribute code. In accordance with the present invention 4 bits from the attribute code are concatenated with the character code so that they provide the most significant bits of a twelve bit word for use in forming the font address.

Figure 5:
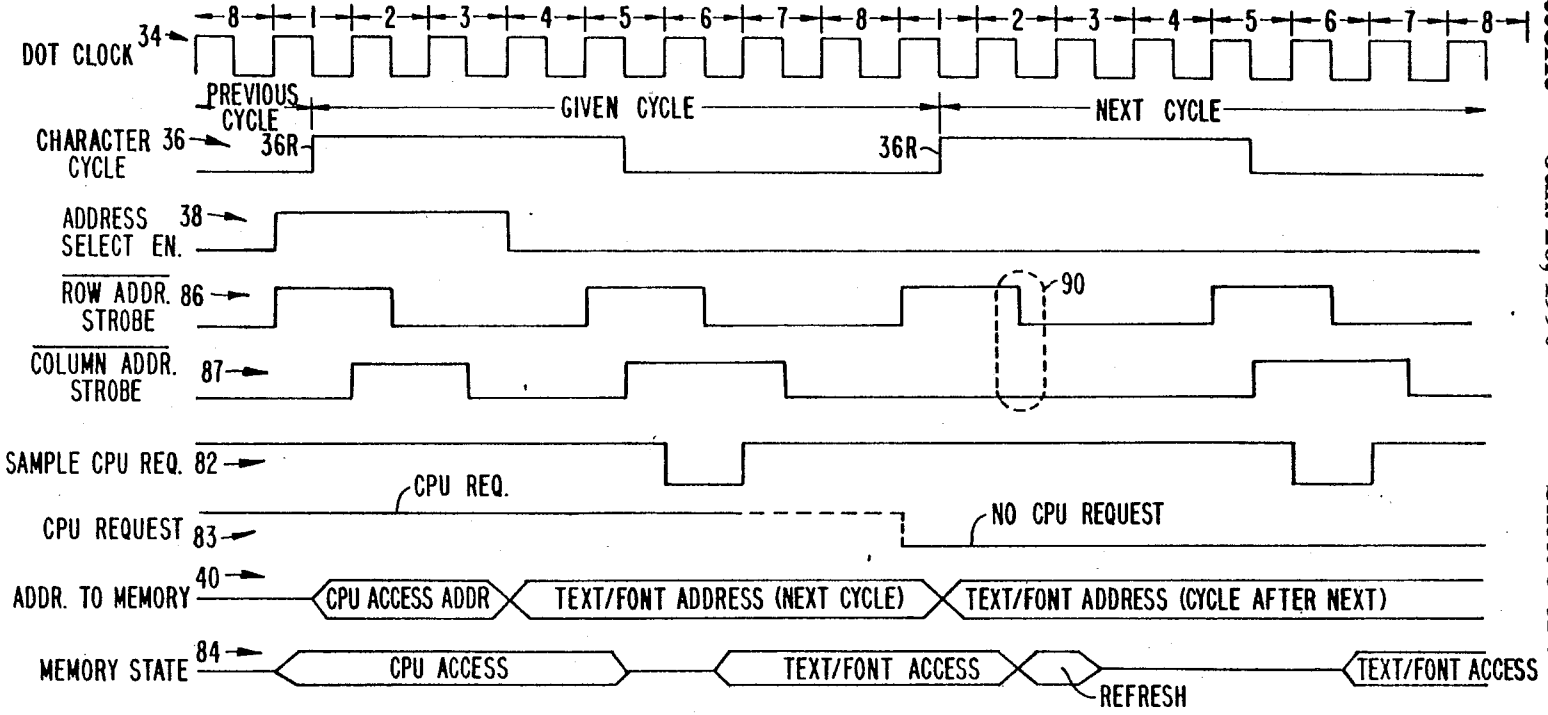
FIG. 5 is a timing diagram illustrating textual data retrieval and font addressing.

As can be seen from FIG. 5, waveform 38, address select line 28 is raised just prior to the rising edge of the next character cycle when a CPU access request is made in the current character cycle. Address select line 28 controls address select circuit 26 to provide, during the low state on address select line 28, the font address from character code register 30 to the font address port of memory 10, and the scanning address from address-/timing circuitry 3 to the text address port of memory 10. When address select line 28 is high, the address on the CPU Access Address line is supplied to both address ports.

Row and column address strobes are asserted during the high state on address select line 28 to enter the font and text addresses into the memory 10 address buffers.

Referring to FIG. 5, in the preferred embodiment of the present invention a character cycle is generally defined as having a length of 8 dot clock cycles. Each dot clock cycle corresponds to the occurrence of a pixel in a scan line on the CRT. The dot clock cycles are illustrated in waveform 34 at the top of FIG. 5. Waveform 36 illustrates the character cycle. The address of the font data for the next character cycle and the actual font data for the current character cycle are loaded into registers 30 and 34 at the rising edge 36R of each character cycle.

Waveform 38 illustrates the state of address select enable line 28. The addresses supplied to the address ports of memory 10 corresponding to the states of waveform 38 are illustrated in waveform 40.

As discussed earlier herein, the textual codes stored in the textual portion of memory 10 include attribute control data. In the preferred embodiment of the present invention, 4 bits out of the 16 bit textual code are employed as the attribute control data. From FIG. 2B it can be seen that 1 bit of the attribute data is used to control the coupling of the output of overstrike generator 48 to summing circuit 50. Another bit of the attribute data is used to control the coupling of the output of underscore generator 52 to summing circuit 50. Finally, a third bit of the attribute data is used to control the coupling of the output of 1 bit delay circuit 54 to summing circuit 50.

Summing circuit 50 can be an OR gate.

One bit delay circuit 54 is utilized to provide an echo path to generate a bold face attribute in the horizontal dimension of the visual display 4. When switch 56 is closed, summing circuit 50 receives from 1 bit delay circuit 54 the bits of parallel/serial register 34 delayed in time by 1 bit. This results in a character having a double width.

Likewise, when switch 58 is closed, an underscore signal is applied to summing circuit 50 in conjunction with the appropriate scan line, in the preferred embodiment scan line 16, for the character for which the underscore attribute has been designated. Similarly, when switch 60 is closed, an overstrike signal is applied to summing circuit 50 at the appropriate scan line position of the character for which the overstrike feature has been designated.

Figure 6:
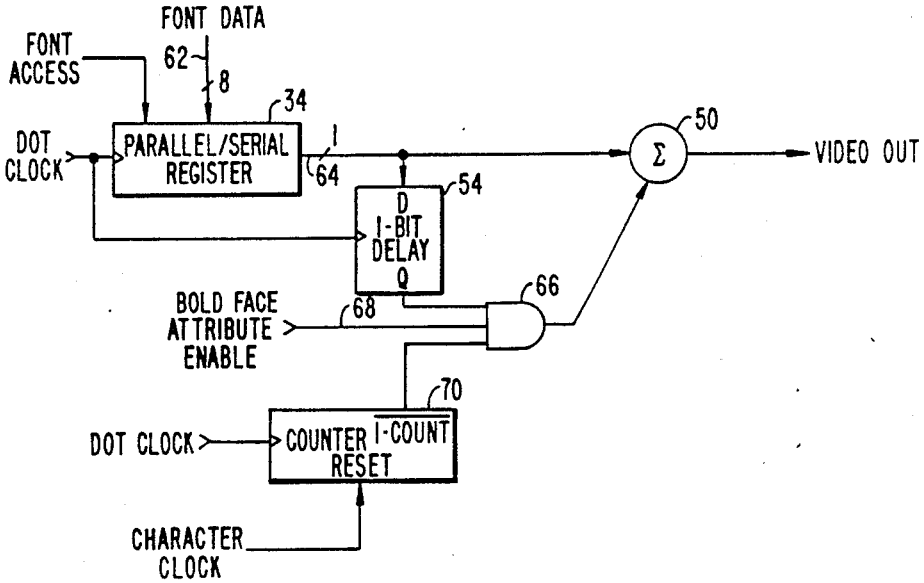
FIG. 6 is a more detailed schematic of the circuitry for generating a bold face attribute.

Referring more particularly to FIG. 6, the circuitry for generating the bold face attribute will be described in greater detail. Parallel/serial register 34 receives 8 bits of font data on font bus 62 and shifts out these 8 bits of data in serial form on line 64. The dot clock is applied to the clock input of parallel/serial register 34 to provide the shift timing. The 1 bit delay circuit 54 can be a D flip flop which is clocked by the dot clock. The output of parallel/serial register 34 is supplied to both the summing circuit 50 and to the D input of 1 bit delay circuit 54. The noninverted output of 1 bit delay circuit 54 is applied to AND gate 66. The bold face attribute data from textual code register 30 is applied as a second input to AND gate 66 on line 68. Finally, a third input is applied to AND gate 66 from counter 70. Counter 70 is incremented at the dot clock rate and reset by the character clock at the beginning of each character cycle. The signal provided by counter 70 to AND gate 66 corresponds to a count of one in the counter 70. This is to disable the echo path to summing circuit 50 for the last bit of the pixel stream passing through 1 bit delay circuit 54 for each character cycle. This prevents the smearing of the character into the next character space as it is displayed on the CRT. In other words, when an echo technique is used to provide a bold face character, the last delayed bit of the pixel stream for the particular scan line of the character tends to smear over into the next character cycle. By suppressing this last delayed bit in the pixel stream, the smearing is eliminated.

Figure 7:
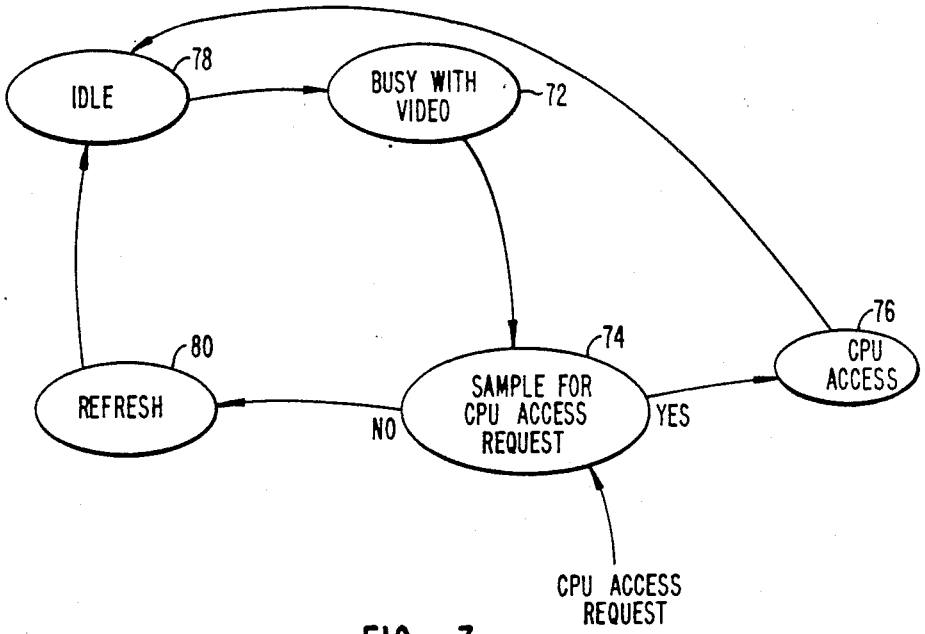
FIG. 7 is a state diagram illustrating the refresh operation of the dynamic memory of the present invention.
Figure 8:
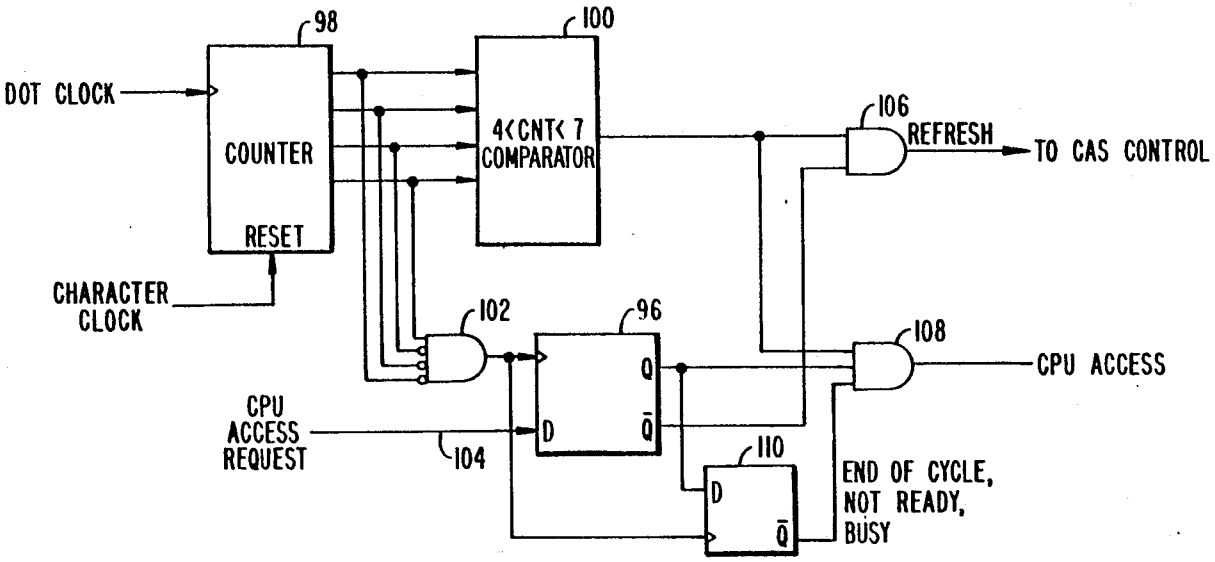
FIG. 8 is a more detailed schematic diagram of the circuitry for controlling access to the dynamic memory of the present invention by the CPU or by a refresh operation.

In the preferred embodiment a continuous address space dynamic memory is used to store both the text and font information. While a continuous address space is present, refreshing of the memory is still needed apart from that which occurs during normal access of the memory. While the textual portion of the memory is scanned continuously, thus requiring no refreshing, the font portion of the memory is accessed randomly and thus requires refreshing. As alluded to above, refreshing of a part of this portion of dynamic memory can be performed during each character cycle. Referring to FIGS. 5, 7 and 8, this refreshing will now be described in greater detail.

As can be seen from FIG. 5, waveform 84, memory 10 will be busy with the generation of the video signal during the last five dot clock cycles of each character cycle. This leaves 3 dot clock cycles of the character cycle for refreshing purposes. However, this period is also shared with the central processing unit 1 to permit the central processing unit 1 to access memory 10. FIG. 7 is a state diagram illustrating the relationship between CPU accesses to memory, refreshing of the memory, and video generation by accessing the memory. State 72 corresponds to the last one and first 3 dot clock cycles of each character cycle. When the video generation has been completed, state 74 is entered. At this point, a check is made to determine whether the CPU wishes to access the memory. If such is the case, state 76 is entered to permit the CPU memory access. When the CPU is done, an idle state 78 is entered. Thereafter, state 72 is entered followed by state 74.

If in state 74 a CPU access request is not detected, state 80 is entered wherein the refresh operation occurs.

In light of the limited amount of time available in any particular character cycle for refreshing, refreshing of the entire font memory portion of memory 10 takes a number of character cycles to complete. The refreshing of the preferred dynamic memory of the present invention is simplified because the particular device keeps an internal record of the next row of memory to be refreshed. When the column address strobe rises, with the row address strobe already high, and remains high as the row address strobe goes low, the device cancels the refresh of the next row of memory. Conversely, when the column address strobe is low when the row address strobe goes low, the memory automatically refreshes the next row.

Waveform 82 illustrates the sampling of the character cycle for a CPU access request. It can be seen that this sampling period occurs during the fifth and sixth dot clock cycles of the character cycle. Waveform 84 illustrates the refreshing of memory 10 during dot clock cycle 2 of the second character cycle of FIG. 5. In the first character cycle of FIG. 5 it can be seen that no refresh address is supplied, this indicating that the CPU has requested access during this period, the request having occurred in the previous character cycle. See waveform 83.

Waveforms 86 and 87 correspond to the row address strobe and column address strobe, respectively. Portion 90 of both waveforms corresponds to the memory refresh condition. As can be seen with portion 92 of both waveforms, a column address strobe is first applied followed by a row address strobe in conjunction with the CPU access of memory.

Referring to FIG. 8, the allocation of memory access between a CPU access request and the refresh function is illustrated in greater detail. In practice, this circuitry is incorporated in the timing/addressing circuitry 3, as is the attribute hardware and textual code and font data registers, which in turn is implemented by way of a logic gate array or standard cells of logic blocks. A request for memory access from the CPU 1 is received by D flip flop 96. See waveform 83, FIG. 5. Counter 98 is reset by the character cycle clock at the beginning of each character cycle and counts dot clock cycles. Comparator 100 is connected to the output of counter 98 and determines when the count is within a certain range, in the preferred embodiment, between 3 and 6. AND gate 102 is coupled to the outputs of counter 98 to provide a clock pulse to D flip flop 96 when the count in counter 98 reaches a predetermined number, in the preferred embodiment, 4. See waveform 82, FIG. 5. Thus, D flip flop 96 is enabled to clock in the logic state present on the CPU request line 104 during dot clock cycle 4 of a character cycle.

Comparator 100 provides an indication of when the memory is in an idle state, i.e., not busy with the accessing of textual or font data. AND gate 106 receives the output of comparator 100 and the inverted output of D flip flop 96. Thus, when the system is in dot clock cycle 5 and 6 of a character cycle and when no CPU request has been received by D flip flop 96, AND gate 106 will provide a logic 1 to indicate that a refresh can occur. Conversely, when D flip flop 96 receives a CPU request, its inverted output will be a logic zero, thus causing AND gate 106 to provide a logic zero at its output, thus disabling any refresh activity.

AND gate 108 receives as one of its inputs the output from comparator 100, and as another input the noninverted output of D flip flop 96. Thus, when comparator 100 indicates that the system is in dot clock cycles 5 and 6 of the character cycle, and when D flip flop 96 indicates that a CPU request has been received, AND gate 108 will provide a logic 1 to indicate that a CPU access is to occur. D flip flop 110 is clocked by the output of AND gate 102 and receives as its input the Q output of D flip flop 96. The inverted output of D flip flop 110 is applied to AND gate 108 to define the end of the CPU access period.

As indicated herein above, the addressing/timing circuitry 3 is implemented in the preferred embodiment by way of a gate array to provide timing and control signals in accordance with the waveforms of FIG. 5 and the state diagram of FIG. 7, to provide the CPU access detection and refresh addressing of FIG. 8, and to provide the address selection signal to address selection circuit 26. It is also to be understood that, as indicated by dotted line 3' in FIG. 2B, the attribute generation circuitry, the textual code register, and the parallel to serial register can all be implemented by way of a logic gate array or standard cells of logic blocks.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention claimed.

I claim:

1. An apparatus for generating characters in a visual display terminal of the type which receives coded characters from the user, transforms the coded characters into a video signal, and displays the video signal on a visual display, wherein the coded characters can be in different selected fonts, the apparatus comprising memory means for storing the coded characters and for storing font data from which the video signal can be generated for each of the coded characters, wherein each of the coded characters is formed from a plurality of bytes of data and includes attribute control data and a font address, and further wherein the font address comprises more than a byte and less than the plurality of bytes of data to provide a predetermined number of possible font addresses, such that the memory means stores font data at each of the possible font addresses and so that each of the stored character codes can provide any one of the possible font addresses, and further wherein the memory means is a dynamic memory having a continuous physical address space;

means for addressing the memory means to read out the coded characters from the memory means and to utilize the font address from each coded character to retrieve the corresponding font data from the memory means;

means responsive to the font data for converting the font data into the video signal; and means for refreshing selected portions of the memory means, wherein the font data corresponding to a particular character is converted into the video signal over a character cycle, and the means for refreshing refereshes the selected portions of the memory means during the character cycle, and further wherein the video signal comprises a plurality of pixels supplied in accordance with a dot clock and a character is represented by a predetermined number of pixels supplied over a character cycle, wherein the refreshing means comprise means responsive to the dot clock and character cycle for determining whether the memory is being accessed for font data or coded characters; and means coupled to the determining means and to the memory means for generating a refresh cycle when the memory is not being accessed for font data or coded characters.

2. The apparatus of claim 1, further including means for generating an attribute signal representative of a selected attribute;

means for summing the video signal with the attribute signal;

means responsive to the attribute control data for selectively coupling the attribute signal to the summing means for combination with the video signal.

3. An apparatus for generating characters in a visual display terminal of the type which receives coded characters from the user, transforms the coded characters into a video signal, and displays the video signal on a visual display, wherein the coded characters can be in different selected fonts, and further wherein the attribute control data includes a bold face attribute signal, the apparatus comprising memory means for storing the coded characters and for storing font data from which the video signal can be generated for each of the coded characters, wherein each of the coded characters is formed from a plurality of bytes of data and includes attribute control data and a font address, and further wherein the font address comprises more than a byte and less than the plurality of bytes of data to provide a predetermined number of possible font addresses, such that the memory means stores font data at each of the possible font addresses and so that each of the stored character codes can provide any one of the possible font addresses;

means for addressing the memory means toread out the coded characters from the memory means and to utilize the font address from each coded character to retrieve the corresponding font data from the memory means;

means responsive to the font data for converting the font data into the video signal;

means for generating an attribute signal representative of a selected attribute;

means for summing the video signal with the attribute signal;

means responsive to the attribute control data for selectively coupling the attribute signal to the summing means for combination with the video signal; and further wherein the attribute generating means comprises means responsive to the video signal for delaying the video signal for a selected period of time, and further wherein the delayed video signal is supplied to the coupling means for selective coupling to the summing means, so that a bold face attribute is provided.

4. The apparatus of claim 3, wherein the video signal comprises a plurality of pixels supplied in accordance with a dot clock and a character is represented by a predetermined number of pixels supplied over a character cycle, and further wherein the coupling means include counter means responsive to the dot clock and reset at the beginning of each character cycle for indicating the first dot clock cycle of each character cycle; and logic means responsive to the counter means, to the bold face attribute signal, and to the delayed video signal for suppressing the delayed video signal when the first dot clock cycle of each character cycle is present.

* * * * *